US006516637B1

(12) United States Patent
Fancher et al.

(10) Patent No.: US 6,516,637 B1
(45) Date of Patent: Feb. 11, 2003

(54) ELASTIC KNITTED BAND AND METHOD OF MANUFACTURE THEREOF

(75) Inventors: J. Von Fancher, Chelsea, AL (US); Ronny Pate, Shelby, AL (US); Ken Durn, Columbiana, AL (US)

(73) Assignee: Elastic Corporation of America, Inc., Columbiana, AL (US)

( * ) Notice: Subject to any disclaimer, the term of this patent is extended or adjusted under 35 U.S.C. 154(b) by 0 days.

(21) Appl. No.: 10/054,411

(22) Filed: Nov. 13, 2001

(51) Int. Cl.[7] ..... D04B 1/00
(52) U.S. Cl. ..... 66/170; 66/192; 66/195
(58) Field of Search ..... 66/191, 192, 193, 66/195, 170, 169 R, 196, 202, 203; 442/305, 306, 312, 313, 314

(56) References Cited

U.S. PATENT DOCUMENTS 4,003,224 A * 1/1977 Odham ..... 66/193
4,215,684 A * 8/1980 Westip ..... 66/193
4,248,064 A * 2/1981 Odham ..... 66/190
4,787,219 A * 11/1988 Sato et al. ..... 66/190
4,818,316 A * 4/1989 Weinle et al. ..... 66/193
5,522,240 A * 6/1996 Wall et al. ..... 66/170
5,632,526 A * 5/1997 McLarty et al. ..... 66/192
5,890,380 A * 4/1999 Ives et al. ..... 66/170
6,079,236 A * 6/2000 Ives et al. ..... 66/170

* cited by examiner

*Primary Examiner*—Danny Worrell
(74) *Attorney, Agent, or Firm*—Wolf, Greenfield & Sacks, P.C.

(57) ABSTRACT

A warp knit elastic band that includes at least one and preferably two filler yarns knitted into the band on an outside surface thereof adjacent either the back weft yarn or the front weft yarn to provide a softer feel and a thicker construction. A method for manufacturing the elastic band is also disclosed in which at least one and preferably two filler yarns are laid into the band adjacent either the back weft yarn or the front weft yarn on a side thereof opposite the elastomer threads. An apparatus for manufacturing an elastic band is also disclosed in which four and preferably five weft insertion bars are used in the following sequence to form a warp knitted elastic band: a first weft yarn bar, an elastomer thread bar, a second weft yarn bar, a first filler yarn bar and a second filler yarn bar.

27 Claims, 9 Drawing Sheets

ELASTIC KNITTED BAND AND METHOD OF MANUFACTURE THEREOF

FIELD OF THE INVENTION

The present invention relates generally to knitted elastic bands, and more particularly to an improved knitted elastic band that has the look and feel of a woven elastic band, and that may be used as a waistband in men's and women's garments.

BACKGROUND OF THE INVENTION

Woven elastic bands are often preferred in apparel by customers over knitted elastic bands because the woven elastic bands have a smoother and thicker feel than the knitted elastic bands, making them appear more expensive and of better quality. Knitted elastic bands, however, are generally much less expensive to manufacture and would be preferred by garment manufacturers for that reason, if not for their less desirable appearance. A typical application for such knitted or woven elastic bands is for use in the waistband of undergarments such as men's underwear and women's lingerie. These elastic bands may also be used in the waistbands of outer garments, such as trousers and the like. Because of their more expensive look and feel, woven bands are typically utilized in high end garments, while knitted elastic bands typically are used in lower-end garments.

Because knitted elastic bands are cheaper to manufacture, there has been a long felt need for a suitable knitted elastic band that combines the low cost of knitting with the high-end appearance of a woven product.

Examples of products intended to fill this need are disclosed in U.S. Pat. Nos. 5,890,380 and 6,079,236. However, products produced in accordance with these patents tend not to be as soft or thick as desired for many apparel applications.

SUMMARY OF THE INVENTION

The present invention relates to a knitted elastic band having additional yarns laid into it during its manufacture to provide the knitted elastic band with the look and feel of a more expensive, woven elastic band. The elastic band of this invention is particularly suited for use as a waistband in undergarments for men and women.

More particularly, in one aspect, a knitted elastic band of this invention includes at least front and back weft or filling yarns, and elastomer threads disposed between the front and back weft yarns. In one embodiment, disposed on one side of the band, either on the technical back or the front, are a first set of filler yarns or plush yarns which provide that surface of the band with a thicker feel and look. In another embodiment of this aspect of the invention, an additional set of filler yarns or stuffer yarns are also introduced on the same side of the band as the first set of filler yarns to provide an even thicker and softer look and feel. Warp yarns knit the entire structure together.

In another aspect of the invention, a method is disclosed for the manufacture of a knitted elastic band having the look and feel of a woven elastic band. In this aspect of the invention, the knitted elastic band is formed on a conventional flat bed weft insertion, warp knitting machine utilizing a plurality of weft insertion bars. Typically, four or five weft insertion bars are utilized. In one embodiment of this method, in which four weft insertion bars are utilized, the weft insertion bars include, in sequence, a first filler or plush insertion bar carrying first filler yarns, a back weft insertion bar carrying a back weft yarn, an elastomer thread insertion bar carrying elastomer threads, and a front weft insertion bar carrying a front weft yarn. In another embodiment of this aspect of the invention, an additional weft insertion bar carrying a second set of filler yarns or stuffer yarns may be positioned in sequence between the first filler bar and the back weft insertion bar. The yarns that are carried by each weft insertion bar are fed through tubes to the knitting needle bed of a conventional warp knitting machine. Warp yarns also are provided to the needle bed of the knitting machine by a warp guide bar.

The elastic band is knitted by laying the first set of filler yarns between the warp knitting needles during the knitting process so that all of the first set of filler yarns are positioned on the band outside and adjacent the back or front weft yarn. If two filler yarn bars are provided, both sets of filler yarns are laid between the warp knitting needles during the knitting process so that both sets of filler yarns are positioned adjacent but outside the back or front weft yarn. The warp yarns knit together the entire structure utilizing conventional crochet or chain stitches.

Typically, both sets of filler yarns are formed of textured polyester. Preferably, the front weft and back weft yarns also are both formed of textured polyester. The elastomer threads may be either a covered or an uncovered synthetic fiber such as spandex, or natural rubber.

The elastic band produced by the method of this invention has a softer feel and a thicker look that is comparable to a woven product yet costs significantly less than a woven product to manufacture.

BRIEF DESCRIPTION OF THE DRAWINGS

The objects, advantages and features of this invention will be more clearly appreciated from the following detailed description, when taken in conjunction with the accompanying drawings, wherein like numbers are used for like features, in which.

DETAILED DESCRIPTION

Figure 1:
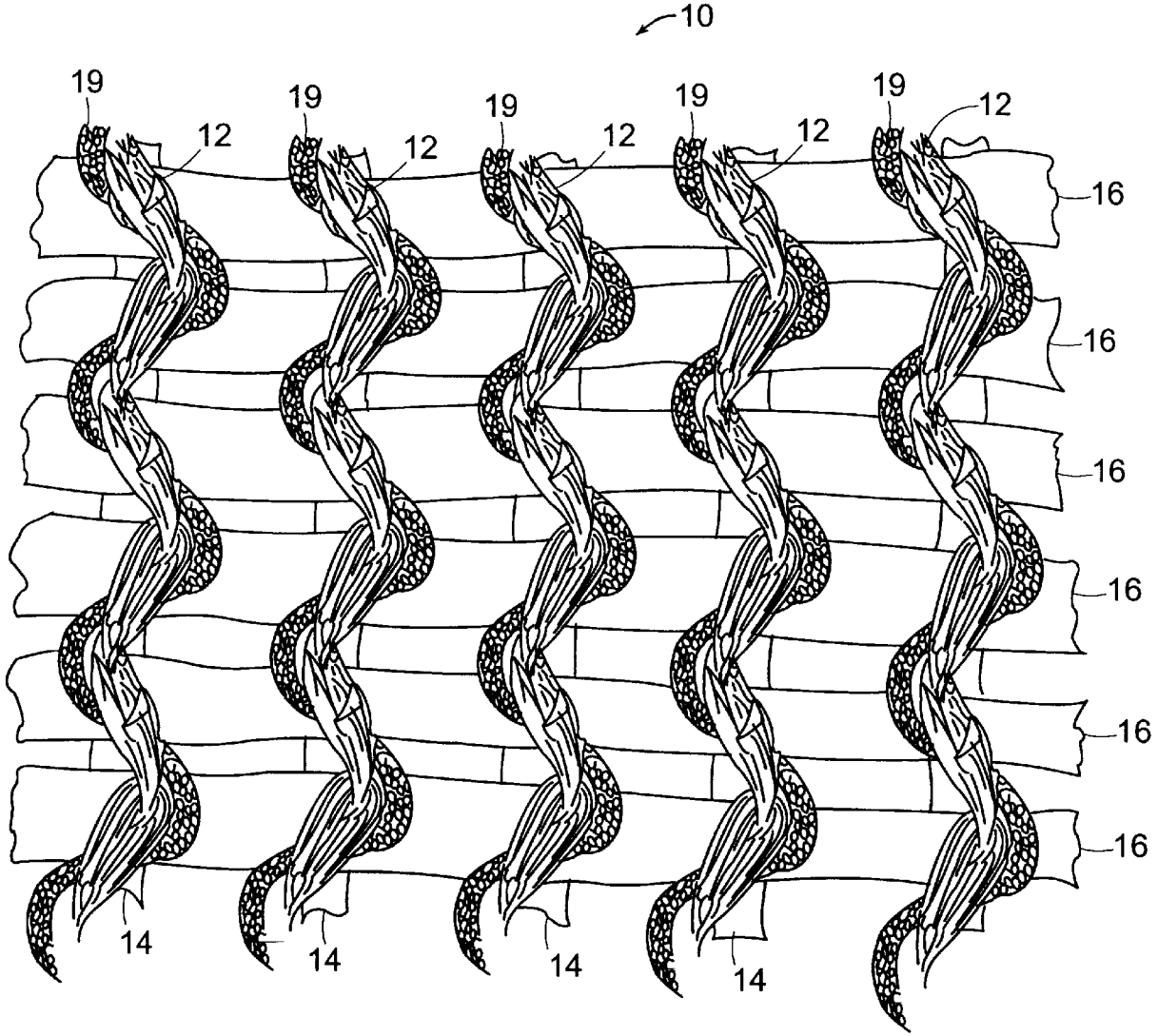
FIG. 1 is a schematic drawing of the technical back of one embodiment of the knitted elastic band of this invention.
Figure 2:
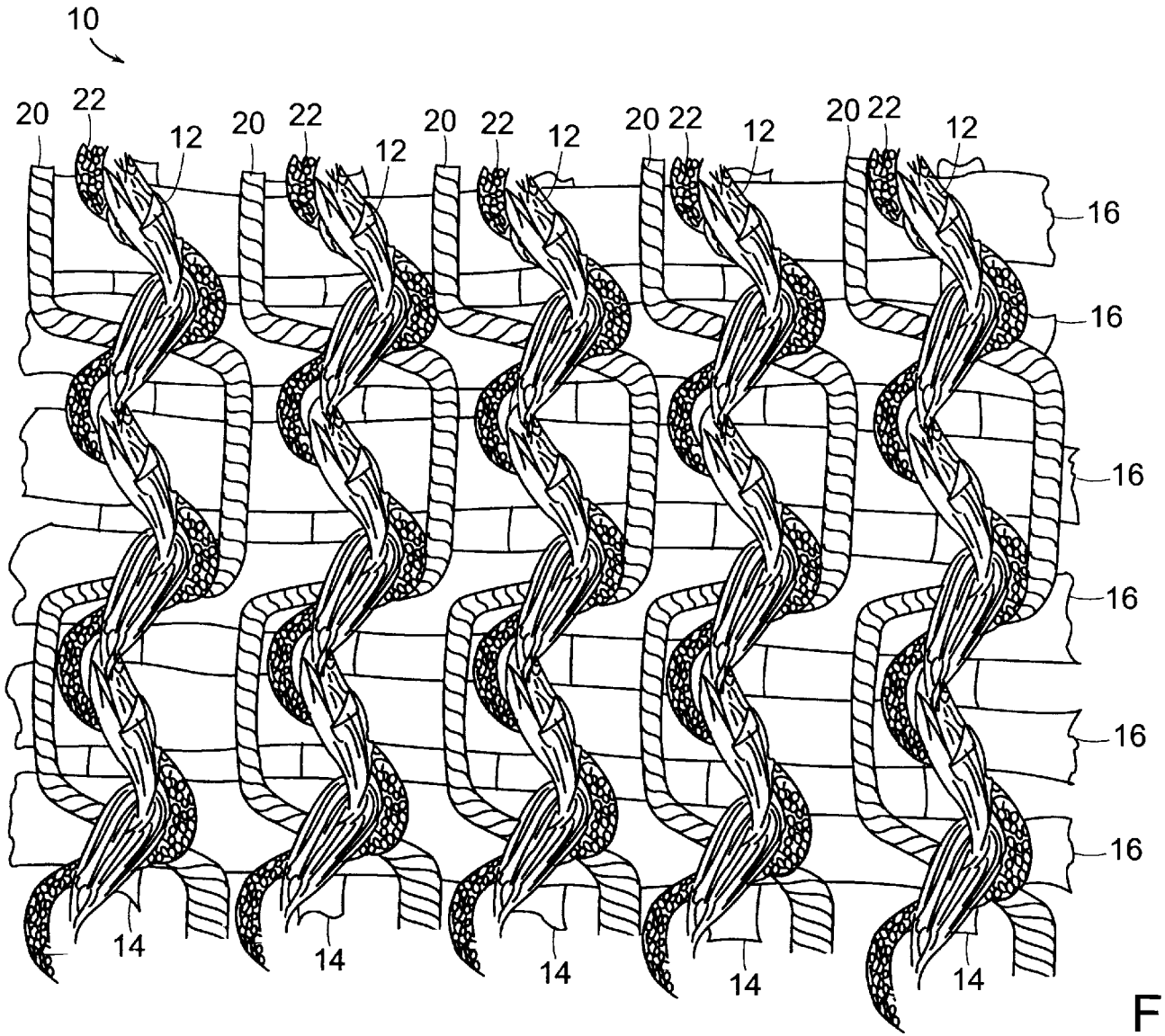
FIG. 2 is a schematic drawing of the technical back of another embodiment of the knitted elastic band of this invention.
Figure 3:
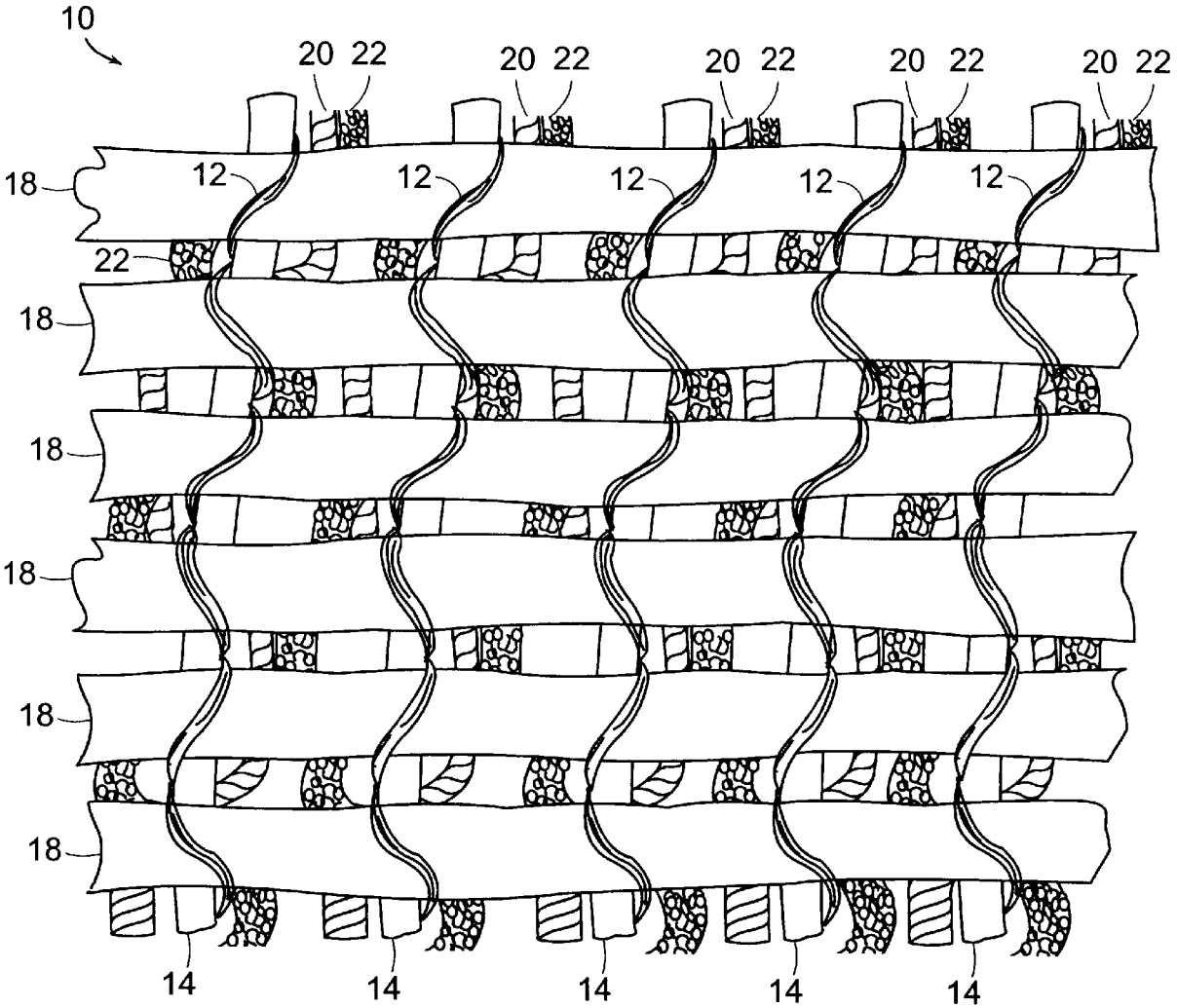
FIG. 3 is a schematic drawing of the technical face of the knitted elastic band of FIG. 2.

With reference now to the drawings, and more particularly to FIGS. 1, 2 and 3 thereof, one aspect of this invention, the structure of knitted elastic band 10, will be described. Band 10 includes warp yarns 12, elastomer threads 14, a back weft yarn 16 and a front weft yarn 18. The number of warp yarns 12 typically equals the number of elastomer threads 14. The number of warp yarns 12 and elastomer threads 14 depends on the width of the elastic band. The elastomer threads 14 and warp yarns 12 extend generally in the warp direction, or in the direction of elongation of band 10. Typically, a single back weft yarn 16 and a single front weft yarn 18 are used. Weft yarns 16 and 18 traverse back and forth in the weft direction or widthwise across the warp yarns 12 and the elastomer threads 14. However, it is understood that if additional cover is desired, more than one back weft yarn 16 and/or front weft yarn 18 may be used. Warp yarns 12 knit the weft yarns 16 and 18 to the elastomer threads 14 utilizing conventional chain stitches or crochet stitches on a conventional weft insertion, flat bed, warp knitting machine.

One embodiment of this aspect of the invention is shown in FIG. 1. In this embodiment, a first set of filler yarns or plush yarns 19 are laid into band 10 during the manufacture thereof. Plush yarns 19 provide band 10 with a softer feel on the back side and a greater thickness. Plush yarns 19 typically are laid into band 10 adjacent the back warp yarn 16 on the technical back, or on a side of the back weft yarn 16 facing away from elastomer threads 14 and front weft yarn 18. In the embodiment shown in FIG. 1, plush yarns 19 are knitted into band 10 at every pick, or in other words, at every pass of the back weft yarn 16 across the band 10. However, plush yarns 19 could be knitted to band 10 at every other pick or even at every third pick. In the embodiment shown in FIG. 1, the plush yarns 19 oscillate in the weft direction 180 degrees out of phase with the elastomer threads 14 during the manufacture of band 10. However, plush yarns 19 could oscillate in phase with elastomer threads 14.

Another embodiment of this aspect of the invention is shown in FIGS. 2 and 3. In this embodiment, band 10 includes a first set of filler yarns which are plush yarns 20, and a second set of filler yarns which are stuffer yarns 22. Plush yarns 20 and stuffer yarns 22 both are disposed on the technical back of band 10, as shown in FIG. 2, or on a side of the back weft yarn 16 facing away from elastomer threads 14 and front weft yarn 18. Stuffer yarns 22 provide band 10 with a greater thickness and cover to give band 10 a more expensive look. Stuffer yarns 22 are disposed between back weft yarn 16 and plush yarns 20 in a typical band. Plush yarns 20 and stuffer yarns 22 are knitted into the structure of band 10 by associated warp yarns 12. In the embodiment shown in FIG. 2, the stuffer yarns 22 are laid into the structure with an oscillation in the weft direction that is 180 degrees out of phase with the oscillation of the elastomer threads 14 during manufacture. Typically, as shown in FIG. 2, the stuffer yarns 22 are knitted into the structure of the band 10 at every pick, or at every passage of back weft yarn 16 in the weft direction across band 10, and plush yarns 20 are knitted into the band 10 at every other pick. However, it is to be understood, that other variations are possible, so that stuffer yarns 22 and plush yarns 20 each could be knitted into the band at every pick, every other pick or even every third pick. While FIG. 2 shows plush yarns 20, oscillating in the weft direction 180 degrees out of phase with the elastomer threads 14, plush yarns 20 could oscillate in phase with elastomer threads 14.

By placing the plush yarns 20 and stuffer yarn 22 on the outside, back face of band 10, the finished band has a softer and thicker, and thus more expensive feel than it would have without plush yarns 20 or stuffer yarns 22 or than it would have if plush yarns 20 and stuffer yarns 22 were disposed between back weft yarn 16 and front weft yarn 18.

Typically, yarns 19, 20 and 22 are textured polyester yarns, although other yarns having a similar feel and texture could be used. A synthetic fiber such as spandex typically is used for threads 14.

Figure 4:
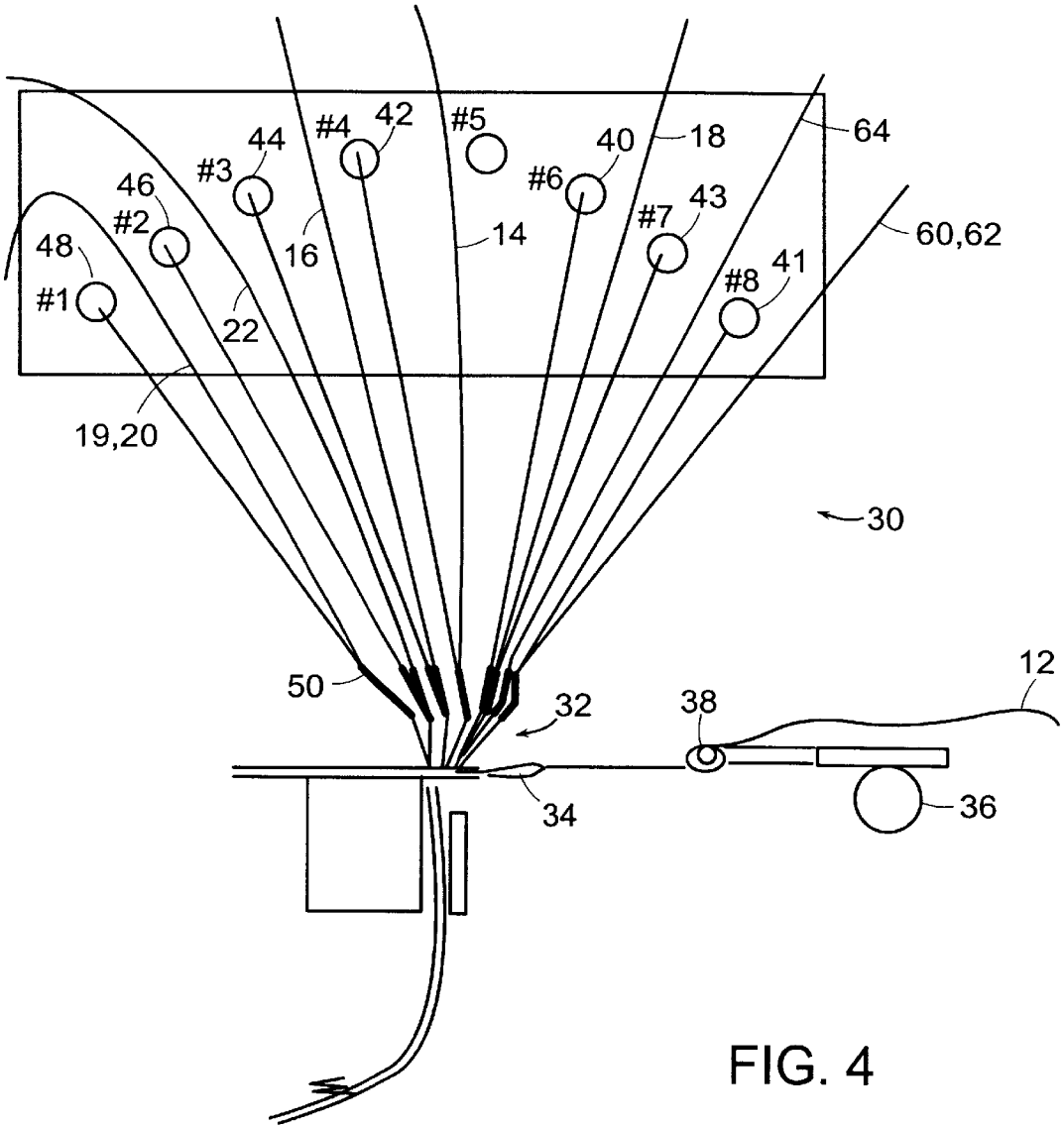
FIG. 4 is a schematic, cross-sectional side view of a conventional warp knitting machine modified in accordance with this invention to produce the elastic band of FIGS. 2 and 3.
Figure 5:
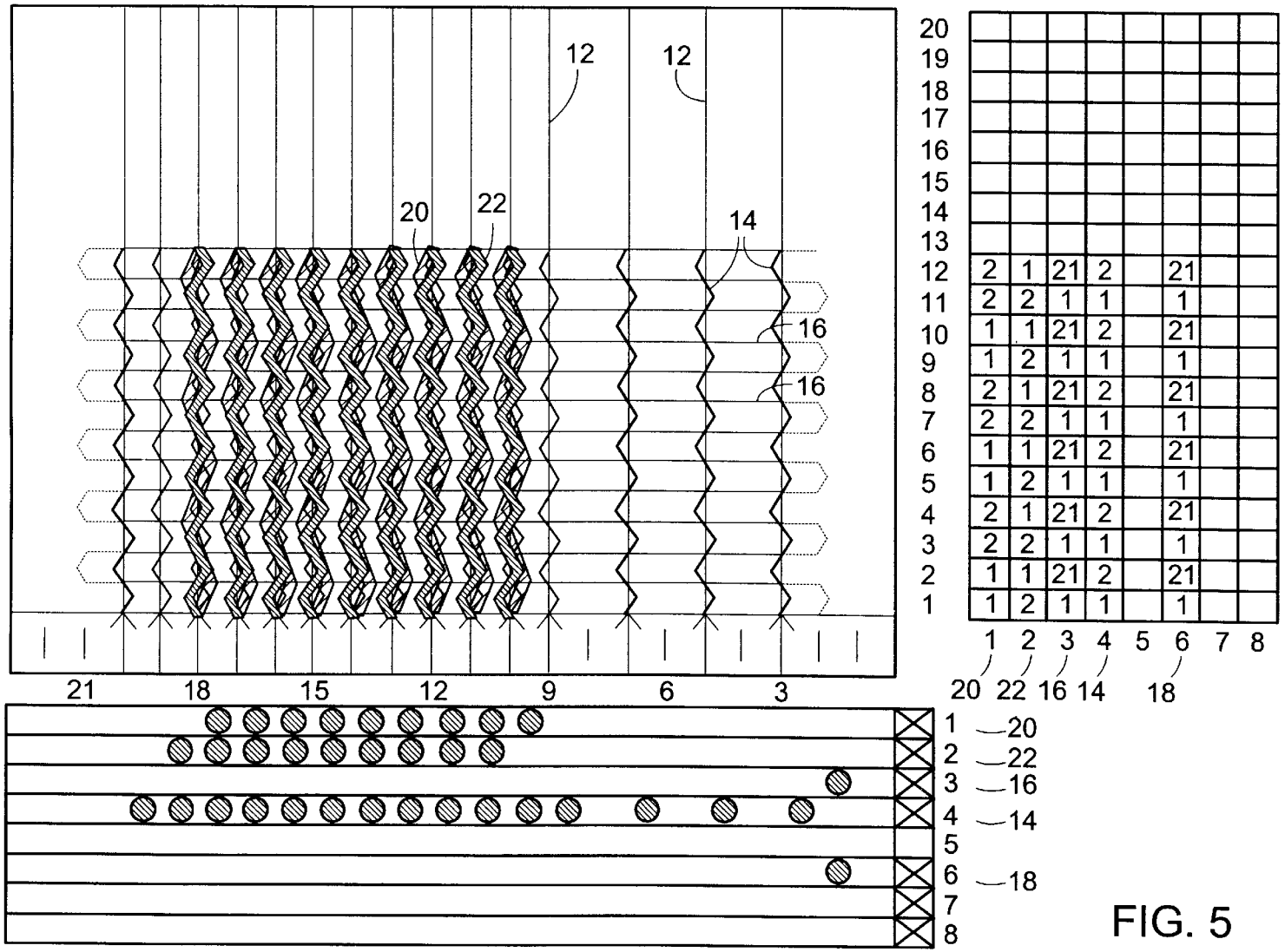
FIG. 5 is a technical drawing showing the stitch notation for one embodiment of the elastic band of FIGS. 2 and 3.

The number of plush yarns 20 typically is the same as the number of stuffer yarns 22, if both plush yarns 20 and stuffer yarns 22 are used in the same structure. The number of such plush yarns 20 and stuffer yarns 22 could be the same as the number of elastomer threads 14 and warp yarns 12, or it could be a number less than the number of elastomer threads 14 and warp yarns 12. For example, in the embodiments illustrated in FIGS. 5 and 6, there are nine ends of plush yarns 20, and nine ends of stuffer yarns 22. There are, however, 15 ends of elastomer threads 14 and 15 ends of warp yarns 12. In the embodiments of FIGS. 4 and 5, elastomer threads 14 which are covered by plush yarns 20 and stuffer yarns 22 are typically uncovered spandex. For those elastomer threads 14 which are not covered by plush yarns 20 or stuffer yarns 22, typically, covered spandex is used.

Figure 6:
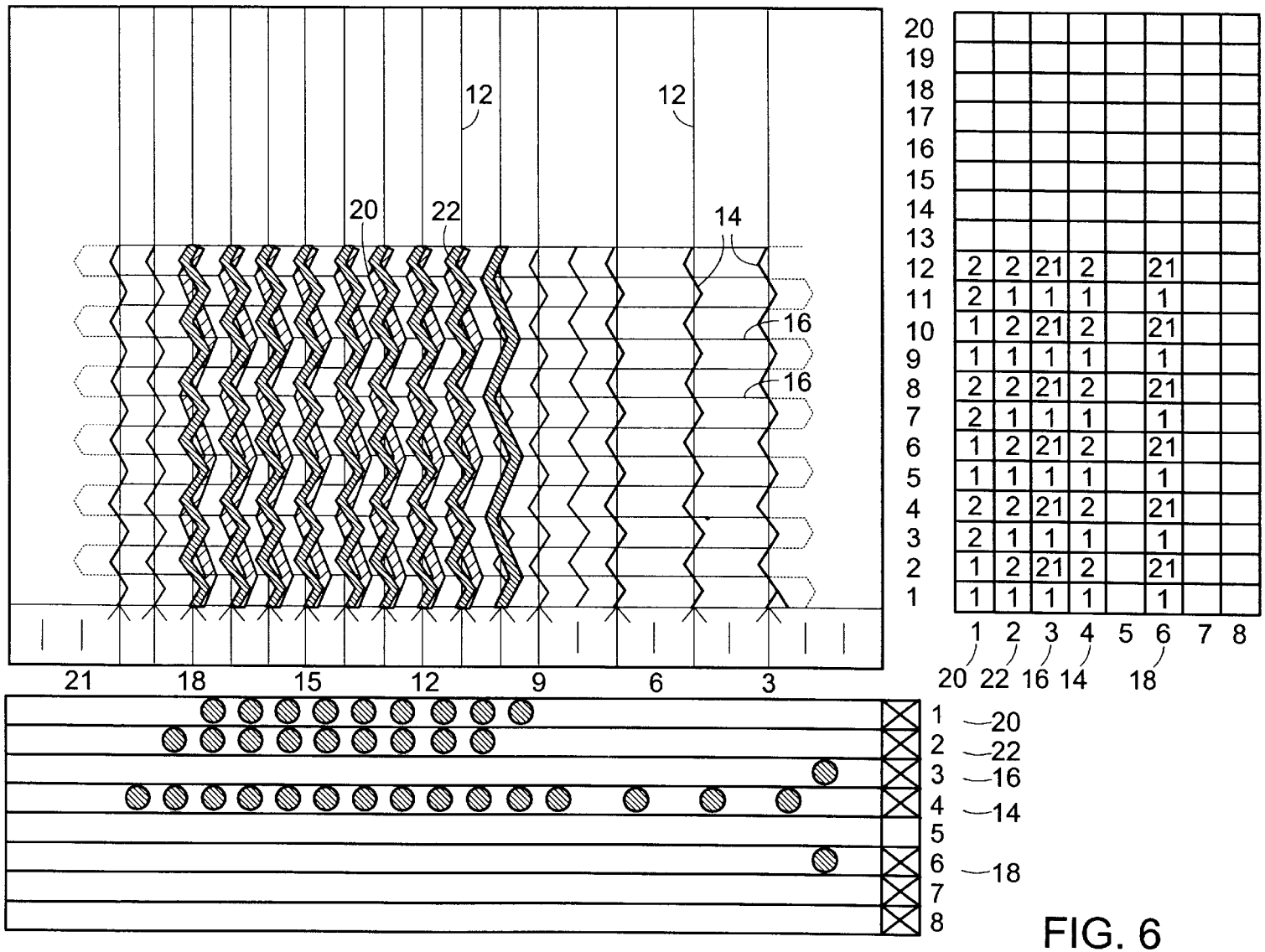
FIG. 6 is a technical drawing showing the stitch notation for another embodiment of the elastic band of FIGS. 2 and 3.

In the embodiment of FIG. 5, the stuffer yarns 22 oscillate in the weft direction 180 degrees out of phase with the elastomer threads 14. In the embodiment of FIG. 6, the stuffer yarns 22 oscillate in the weft direction in phase with the elastomer threads 14 during the manufacture of the band 10. In both embodiments of FIGS. 5 and 6, the stuffer yarns 22 are knitted at every pick, while the plush yarns 20 are knitted at every other pick.

Figure 7:
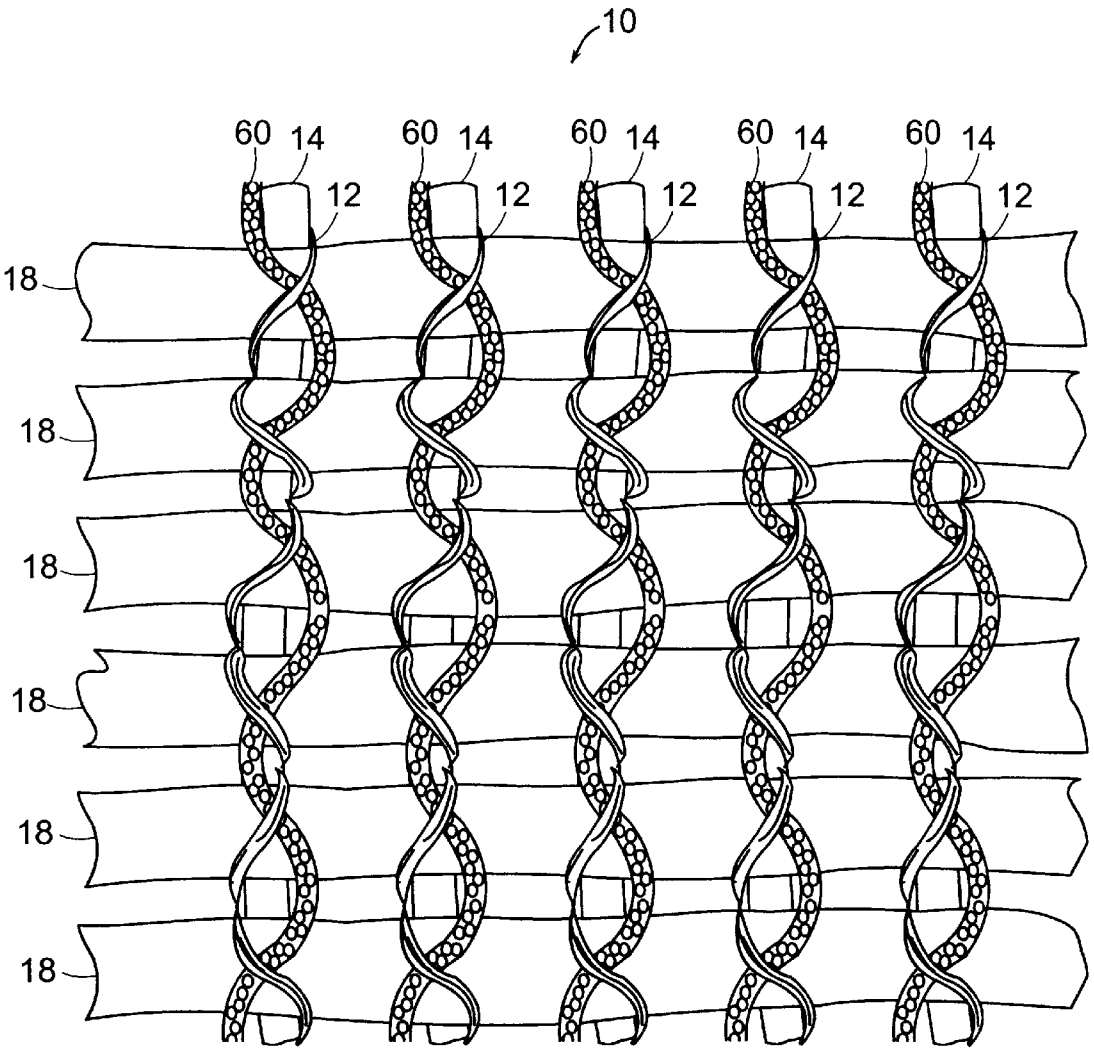
FIG. 7 is a schematic drawing of the technical face of yet another embodiment of the knitted elastic band of this invention.
Figure 8:
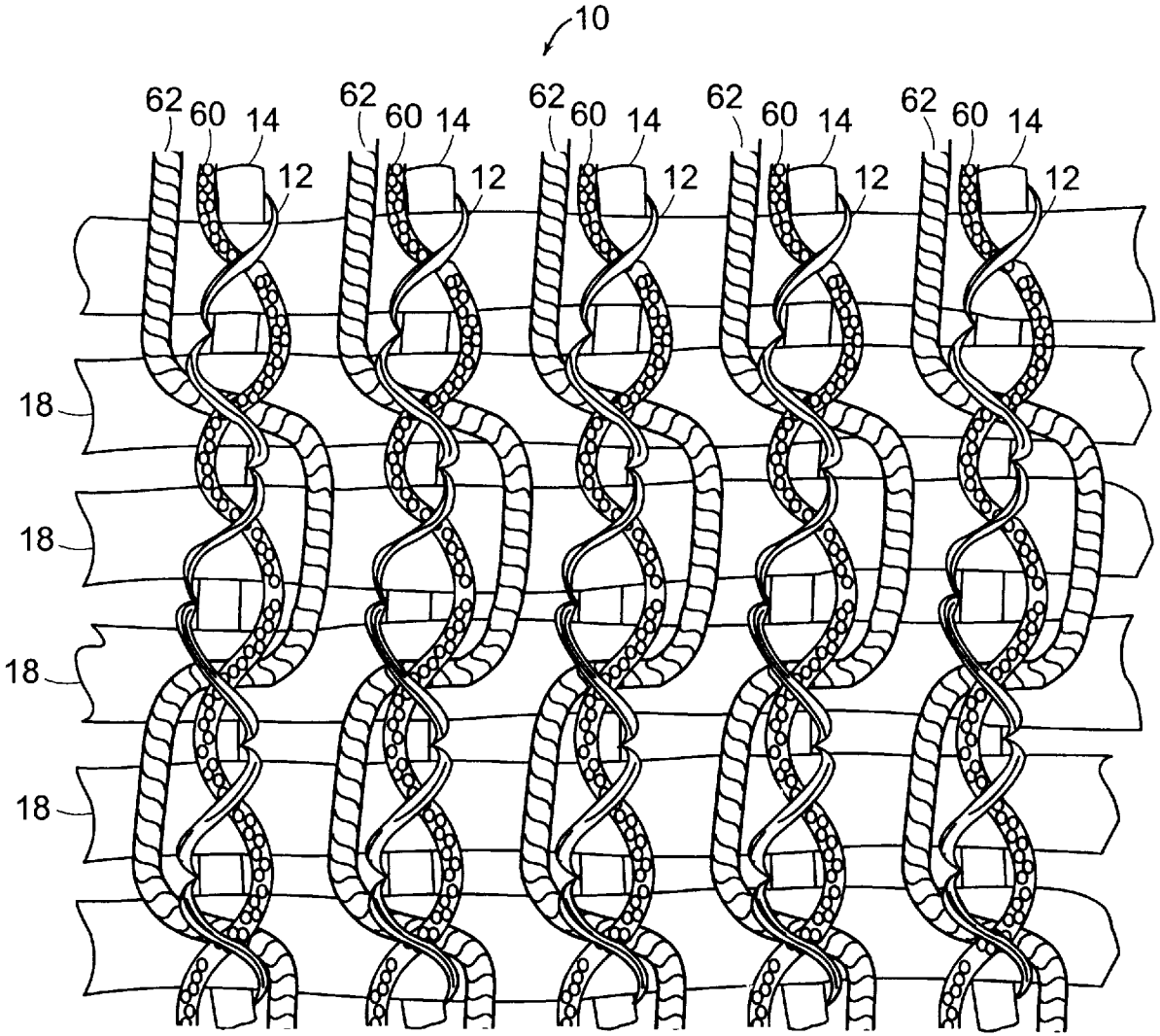
FIG. 8 is a schematic drawing of the technical face of yet another further embodiment of the knitted elastic band of this invention.
Figure 9:
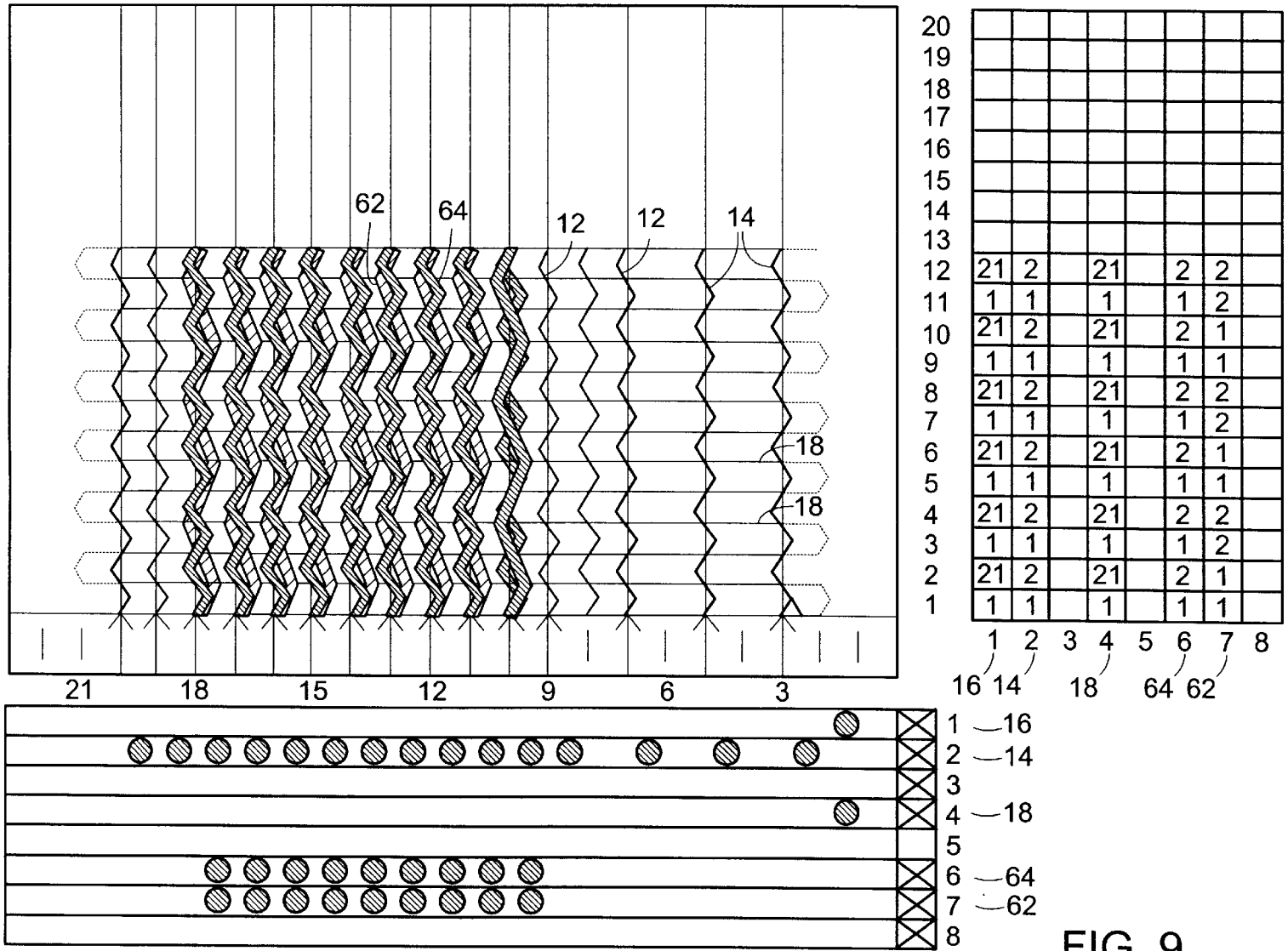
FIG. 9 is a technical drawing showing the stitch notation for the embodiment of FIG. 8.

In other embodiments of this aspect of the invention, as illustrated in FIGS. 7–9, plush yarns and stuffer yarns are positioned outside but adjacent front weft yarn 18 on a side thereof facing away from back weft yarn 16 and elastomer threads 14, instead of, or in addition to, plush yarns 19 or 20 and stuffer yarns 22 which are shown in FIGS. 1–3 as being adjacent back weft yarn 16. In the embodiment of FIG. 7, a first set of filler yarns or plush yarns 60 are laid into band 10 during the manufacture thereof. Plush yarns 60 provide band 10 with a softer feel on the front side and a greater thickness. Plush yarns 60 typically are laid into band 10 adjacent the front weft yarn 18 on the technical face, or on a side of front weft yarn 18 facing away from elastomer threads 14, and away from back weft yarn 16. In the embodiment of FIG. 7, plush yarns 60 are knitted into band 10 at every pick. However, plush yarn 60 could be knitted into band 10 at every other pick, or even at every third pick. In the embodiment shown in FIG. 7, the plush yarn 60 oscillate in the weft direction in phase with elastomer threads 14 during the manufacture of band 10. However, plush yarn 60 could oscillate 180 degrees out of phase with elastomer threads 14.

Another variation of this embodiment of the invention is shown in FIGS. 8 and 9. In this embodiment, band 10 includes a first set of filler yarns which are plush yarns 62 and a second set of filler yarns which are stuffer yarns 64. Plush yarns 62 and stuffer yarns 64 both are disposed on a technical face of band 10, as shown in FIG. 8, or on a side of the front weft yarn 18 facing away from elastomer threads 14 and away from back weft yarn 16. Stuffer yarns 64 provide band 10 with a greater thickness and cover to give band 10 a more expensive look and feel. Stuffer yarns 64 are disposed between front weft yarn 18 and plush yarns 62 in a typical band. Plush yarns 62 and stuffer yarns 64 are knitted into the structure of band 10 by associated warp yarns 12. In the embodiment shown in FIG. 8, the stuffer yarns 64 are laid into the structure with an oscillation in the weft direction that is in phase with the oscillation of the elastomer threads in the weft direction during manufacture. Typically, as shown in FIG. 8, the stuffer yarns 64 are knitted into the structure of the band at every pick, or at every passage of back weft yarn 18 in the weft direction across band 10, and plush yarns 62 are knitted into the band at every other pick. However, it is to be understood, that other variations are possible, so that stuffer yarns 64 and plush yarns 62 each could be knitted into the band at every pick, every other pick, or even every third pick. While FIG. 8 shows stuffer yarns 64 oscillating in the weft direction in phase with the elastomer threads 14, stuffer yarns 64 could oscillate 180 degrees out of phase with elastomer threads 14.

As with the embodiment of FIGS. 2 and 3, typically, yarns 60, 62 and 64 are textured yarns, and the number of plush yarns 62 typically is the same as the number of stuffer yarns 64, when both plush yarns 62 and stuffer yarns 64 are used in the same structure. The number of such plush yarns 62 and stuffer yarns 64 could be the same as the number of elastomer threads 14 and warp yarns 12, or it could be a number less than the number of elastomer threads 14 and warp yarns 12. In the example of FIG. 9, there are nine ends of plush yarns 62, nine ends of stuffer yarns 64, 15 ends of elastomer threads 14 and 15 ends of warp yarns 12. In the embodiment of FIG. 9, stuffer yarns 64 oscillate in the weft direction in phase with elastomer threads 14, although they could oscillate 180 degrees out of phase with the elastomer threads 14 during the manufacture of band 10. In the embodiment of FIG. 9, the stuffer yarns 64 are knitted at every pick, while the plush yarns 62 are knitted at every other pick.

Another aspect of this invention, the machine used to manufacture band 10, will now be described with particular reference to FIG. 4. FIG. 4 schematically illustrates a typical setup of a conventional, flat bed, weft insertion, warp knitting machine 30 configured to manufacture elastic band 10 of FIGS. 2 and 3. Machine 30 includes a needle bed 32 having one crochet needle 34 for each warp yarn 12. Warp yarns 12 are fed to needles 34 from warp yarn bar 36, through needles 38. A typical example of a suitable machine is a Comez® brand crochet knitting machine Model No. 408B894.

Machine 30 typically comes with three weft insertion bars for knitting a conventional elastic band. However, for manufacturing band 10 of this invention, additional weft insertion bars must be added. If only plush yarns 19 or 60 are utilized, four weft insertion bars are required. If both plush yarns 20 or 62 and stuffer yarns 22 or 64 are utilized, five weft insertion bars are necessary. The weft insertion bars include, in sequence, from right to left as shown in FIG. 4, front weft insertion bar 40, elastomer insertion bar 42, and back weft insertion bar 44. In addition, if only a plush yarn 19 is used as in the band of FIG. 1, and if that plush yarn 19 is disposed adjacent and beyond the technical back, and if no stuffer yarn 22 is provided, the next weft insertion bar in sequence going from right to left in FIG. 4, is weft insertion bar 46. If both stuffer yarns 22 and plush yarns 20 are utilized and the band of FIGS. 2 and 3 is made, the sequence of weft insertion bars, going from right to left, in FIG. 4, is the front weft insertion bar 40, the elastomer insertion bar 42, the back weft insertion bar 44, the stuffer insertion bar 46 and the plush insertion bar 48. Front weft insertion bar 40 carries weft yarn 18, elastomer insertion bar 42 carries elastomer threads 14, back weft insertion bar 44 carries back weft yarn 16, stuffer insertion bar 46 carries stuffer yarns 22 and plush insertion bar 48 carries plush yarns 20. Back weft yarn 16, front weft yarn 18, elastomer threads 14, plush yarns 20 and stuffer yarns 22 are all fed from their respective insertion bars through an associated tube 50 to needle bed 32. The front and back weft insertion bars 40 and 44 respectively traverse back and forth across the width of the band in the weft direction, either in phase, or 180 degrees out of phase, to cover the front and back of the band 10 respectively. The elastomer insertion bar 42 oscillates back and forth in a weft direction at each pick to produce the knitted structure. The stuffer insertion bar 46 and the plush insertion bar 48 each oscillate back and forth in the weft direction either in phase, or 180 degrees out of phase with the elastomer insertion bar 42. Each bar 46 and 48 may oscillate back and forth at each pick, every other pick or at every third pick.

If the embodiment of FIG. 7 is made, the sequence of weft insertion bars, going from right to left in FIG. 4 is a plush insertion bar 41, front weft insertion bar 40, elastomer insertion bar 42 and back weft insertion bar 44. If the embodiment of FIGS. 8 and 9 is made, the sequence of weft insertion bars, going from right to left in FIG. 4 is plush insertion bar 41, a stuffer insertion bar 43, front weft insertion bar 40, the elastomer insertion bar 42 and back weft insertion bar 44. Front weft insertion bar 40 carries weft yarn 18, elastomer insertion bar 42 carries elastomer threads 14, back weft insertion bar 44 carries back weft yarn 16, stuffer insertion bar 43 carries stuffer yarns 64 and plush insertion bar 41 carries plush yarns 60 or 62. Machine 30 is operated in substantially the same manner to manufacture the embodiments of FIGS. 7–9 as it is operated to manufacture the embodiments of FIGS. 1–3.

In yet another aspect of this invention, one example of the method of knitting the elastic band 10 of FIGS. 2 and 3 is illustrated in FIG. 5. In this example, stuffer insertion bar 46 oscillates 180 degrees out of phase with elastomer insertion bar 42. In this embodiment, plush insertion bar 48 oscillates such that plush yarns 20 are knitted into the fabric only at every other pick. Stuffer insertion bar 46 oscillates such that stuffer yarns 22 are knitted into the fabric at every pick.

Another example of the method of knitting elastic band 10 of FIGS. 2 and 3 is illustrated in FIG. 6. The only difference between FIGS. 5 and 6 is that stuffer bar 46 oscillates in phase with elastomer insertion bar 42 in FIG. 6. In all other respects, the embodiment of FIG. 6 is identical to the embodiment of FIG. 5.

In the embodiments of FIGS. 5 and 6, the warp yarns are illustrated by the arrows and are found at positions 3, 5, 9, 10, 11, 12, 13, 14, 15, 16, 17, 18, 19 and 20. Plush yarns 20 and stuffer yarns 22 are found only at positions 10–18. Elastomer threads 14 are found at each of positions 3, 5, 7 and 9–20. The elastomer threads 14 found at positions 3, 5, 7 and 20 typically are covered spandex. The elastomer threads 14 found at positions 9–19 typically are uncovered spandex. It is to be understood, however, that covered spandex may be used for all threads 14, or that uncovered spandex may be used for all threads 14, or that uncovered spandex or covered spandex can be used in any position for thread 14 as desired. It is also to be understood that plush yarns 20 may be knitted into the band 10 at every pick, or even at every third pick, instead of every other pick. Similarly, stuffer yarns 22 could be knitted into the structure of band 10 at every second pick, or every third pick, instead of at every pick.

In the embodiments of both FIGS. 5 and 6, elastomer threads 14, plush yarns 20 and/or stuffer yarns 22 are knitted together and to back weft yarn 16 and front weft yarn 18 by knitting machine 30 using warp yarns 12. Machine 30 forms conventional crochet stitches with each warp yarn 12 utilizing crochet needles 34 in a manner that is well known to those of ordinary skill in the art. Therefore, this aspect of the knitting method of this invention need not be described further.

An example of the method of knitting elastic band 10 of FIG. 8 is illustrated in FIG. 9. In this example, the stuffer insertion bar 43 oscillates in phase with the elastomer insertion bar 42 such that the stuffer yarns 64 are knitted into the fabric at every pick. The plush insertion bar 41 oscillates such that plush yarns 62 are knitted into the fabric at every other pick. As in the embodiments of FIGS. 5 and 6, the warp yarns are illustrated by the arrows and are found at positions 3, 5, 7, and 9–20. Plush yarns 62 and stuffer yarns 64 are found only at positions 10–18. Elastomer threads 14 are found at each of positions 3, 5, 7, and 9–20. The elastomer threads 14 found at positions 3, 5, 7 and 20 typically are spandex or covered Lycra®. The elastomer threads 14 found at positions 9–19 typically are spandex, or uncovered Lycra®. It is to be understood that plush yarns 60 and 62 could be knitted into the band 10 at every pick, at every other pick or even at every third pick. Similarly, stuffer yarns 64 could be knitted into the structure of band 10 at every second pick, or every third pick, instead of at every pick. As in the embodiment of FIGS. 5 and 6, elastomer threads 14, plush yarns 62 and stuffer yarns 64 are knitted together and to front weft yarn 18 and back weft yarn 16 by the knitting machine using warp yarns 12. The machine forms conventional crochet stitches with each warp yarn 12 utilizing the crochet needles in a manner that is well-known to those of ordinary skill in the art.

The elastic band 10 of this invention has a softer feel than prior art elastic bands. In addition, band 10 is thicker and is more plush and expensive looking than prior art knitted elastic bands. The look and feel of band 10 approaches that of a woven elastic band. Elastic band 10 is particularly suited for use as the waistband of undergarments, particularly men's and women's underwear. The resulting band 10 has a "grin", or exposure of elastomer threads 14 on the outside surface, which is reduced with respect to conventional knitted elastic bands after printing, continuous dyeing, atmospheric dyeing and pressure dyeing. In addition, the use of plush yarns 20 and stuffer yarns 22 allows much better die penetration and uniformity for all colors. The use of spandex for elastomer threads 14 in the structure of band 10 produces less chance of runback or pulling out of threads 14. When the band is subjected to heat in the finishing process, both the covered and bare elastomer threads 14 shrink uniformly to form a tight and stable edge.

Each of yarns 12, 16, 18, 19, 20, 22, 60, 62 and 64, preferably is a textured polyester yarn. Preferably, 150 denier yarn is used. However, it is to be understood, that other types of yarns with other deniers could be used. One type of spandex that may be used for elastomer threads 14 is Lycra®. Other types of elastomer threads 14 could be used, such as natural rubber threads or other types of spandex.

Modifications and improvements within the scope of this invention will occur to those skilled in the art. The above description is intended to be exemplary only. The scope of this invention is defined only by the following claims and their equivalents.

What is claimed is:

1. A knit elastic band comprising:

a plurality of elastomer threads extending generally parallel to one another in a direction of elongation;

a first weft yarn passing back and forth across said plurality of elastomer threads in a direction generally perpendicular to said direction of elongation, said first weft yarn having a first side facing one side of said elastomer threads;

a second weft yarn passing back and forth across said elastomer threads in a direction generally perpendicular to said direction of elongation, said second weft yarn being disposed on a second side of said elastomer threads opposite of said one side;

a plurality of first filler yarns disposed adjacent a second side of said first weft yarn opposite said first side whereby said first weft yarn is disposed between said first filler yarns and said elastomer threads and;

a plurality of warp yarns knitting together said elastomer threads, said first weft yarn, said second weft yarn and said first filler yarns with a crochet knitting stitch.

2. The knit elastic band of claim 1 further comprising a plurality of second filler yarns disposed on said second side of said first weft yarn, said second filler yarns being knitted into said band along with said first filler yarns by said warp yarns.

3. The knit elastic band of claim 1 wherein said first filler yarns are knitted into said band at every pick.

4. The knit elastic band of claim 2 wherein said first filler yarns are knitted into said band at every pick, and said second filler yarns are knitted into said band at every other pick.

5. The knit elastic band of claim 2 wherein said first filler yarns and said second filler yarns are textured polyester yarns.

6. The knit elastic band of claim 2 wherein said first filler yarns are disposed between said first weft yarn and said second filler yarns.

7. The knit elastic band of any one of claims 1–6 wherein said first weft yarn is a front weft yarn and said second weft yarn is a back weft yarn.

8. The knit elastic band of any one of claims 1–6 wherein said first weft yarn is a back weft yarn and said second weft yarn is a front weft yarn.

9. A flat bed, weft insertion, warp knitting machine for knitting an elastic band comprising:

a needle bed;

a warp yarn bar; and a plurality of weft insertion bars for introducing yarns to the needle bed, said weft insertion bars comprising, in sequence:

a first weft yarn bar carrying a first weft yarn;

an elastomer thread bar carrying elastomer threads;

a second weft yarn bar carrying a second weft yarn; and a first filler yarn bar carrying first filler yarns.

10. The knitting machine of claim 9, further comprising, after said first filler yarn bar, a second filler yarn bar carrying second filler yarns.

11. The knitting machine of claim 9, wherein said first filler yarn bar and said elastomer thread bar oscillate back and forth in a weft direction in phase with one another.

12. The knitting machine of claim 9, wherein said elastomer thread bar and said first filler yarn bar oscillate back and forth in a weft direction 180 degrees out of phase with one another.

13. The knitting machine of claim 9, wherein said first filler yarn bar oscillates back and forth in a weft direction at every pick.

14. The knitting machine of claim 9, wherein said second filler yarn bar oscillates back and forth in a weft direction at every other pick.

15. A method for manufacturing a crochet knit, elastic band comprising the steps of:

providing a flat bed, weft insertion, warp knitting machine having an elongate needle bed for knitting together yarns;

introducing to the needle bed warp yarns from a warp yarn bar;

providing a plurality of weft insertion bars in a sequence that includes a first weft yarn bar carrying a first weft yarn, an elastomer thread bar carrying elastomer threads, a second weft yarn bar carrying a second weft yarn, and a first filler yarn bar carrying first filler yarns;

feeding the first weft yarn, the elastomer threads, the second weft yarn, and the filler yarns to the needle bed whereby the elastomer threads are disposed between the first and second weft yarns and the first filler yarn is not disposed between the first and second weft yarns; and operating the needle bed to knit together the first weft yarn, the elastomer threads, the second weft yarn and the filler yarns with the warp yarns using a crochet knitting stitch.

16. The method of claim 15 wherein said second providing step further includes the step of providing a second filler yarn weft insertion bar carrying second filler yarns in sequence after the first filler yarn bar.

17. The method of claim 16, wherein said feeding step comprises the step of laying in the first and the second filler yarns in a direction generally parallel to said elastomer threads.

18. The method of claim 15, wherein said operating step further comprises the step of oscillating the elastomer thread bar back and forth in a weft direction at each pick.

19. The method of claim 18, wherein said operating step further comprises the step of oscillating the first filler yarn bar in a weft direction generally in phase with oscillations in the weft direction of the elastomer thread bar.

20. The method of claim 18, wherein said operating step further comprises the step of oscillating the first filler yarn bar in a weft direction generally 180 degrees out of phase with oscillations in the weft direction of the elastomer thread bar.

21. The method of claim 16, wherein the operating step further comprises the step of oscillating the second filler yarn bar in a weft direction whereby the second filler yarn bar reverses its direction of oscillation at every other pick.

22. The method of claim 15, wherein said operating step comprises the step of knitting the first filler yarns to the band at every pick.

23. The method of claim 16, wherein said operating step comprises the step of knitting the second filler yarns to the band at every other pick.

24. The method of claim 16, wherein said feeding step comprises the step of laying in the first and the second filler yarns adjacent the second weft yarn on a side thereof opposite the elastomer threads.

25. The method of any one of claims 15–24 wherein the first weft yarn bar is a front weft yarn bar carrying a front weft yarn and the second weft yarn bar is a back weft yarn bar carrying a back weft yarn.

26. The method of any one of claims 15–24 wherein the first weft yarn bar is a back weft yarn bar carrying a back weft yarn and the second weft yarn bar is a front weft yarn bar carrying a front weft yarn.

27. A method for manufacturing a warp knit elastic band comprising the steps of:

providing a flat bed, warp knitting, weft insertion machine having an elongate needle bed for carrying and reciprocating a plurality of knitting needles;

providing a plurality of weft insertion bars having a plurality of yarn guides, the weft insertion bars comprising in sequence a first weft yarn bar carrying a first weft yarn, an elastomer thread bar carrying elastomer threads, a second weft yarn bar carrying a second weft yarn, a first filling yarn bar carrying first filling yarns and a second filling yarn bar carrying second filling yarns; and operating the knitting machine to knit an elastic band by introducing to the needle bed in sequence the first weft yarn, the elastomer threads, the second weft yarn, the first filling yarns and the second filling yarns, the first and second filling yarns being laid into the band adjacent the second weft yarn on a side thereof opposite the elastomer threads.

* * * * *